US011319917B2

(12) United States Patent
Boll et al.

(10) Patent No.: US 11,319,917 B2
(45) Date of Patent: May 3, 2022

(54) IGNITION COIL AND IGNITION SYSTEM FOR A VEHICLE

(71) Applicants: DENSO International America, Inc., Southfield, MI (US); Denso Corporation, Kariya (JP)

(72) Inventors: Harrison Boll, Grosse Pte Farms, MI (US); Jeongung Hwang, Northville, MI (US)

(73) Assignees: DENSO International America, Inc., Southfield, MI (US); DENSO Corporation, Kariya (JP)

( * ) Notice: Subject to any disclaimer, the term of this patent is extended or adjusted under 35 U.S.C. 154(b) by 392 days.

(21) Appl. No.: 16/441,545

(22) Filed: Jun. 14, 2019

(65) Prior Publication Data

US 2020/0392933 A1 Dec. 17, 2020

(51) Int. Cl.

| | |
|---|---|
| ***F02P 3/00*** | (2006.01) |
| ***F02P 3/055*** | (2006.01) |
| ***H01F 38/12*** | (2006.01) |

(52) U.S. Cl.

CPC ..... *F02P 3/055* (2013.01); *H01F 38/12* (2013.01)

(58) Field of Classification Search

CPC ..... H01F 38/12; H01F 27/025; H01F 27/08; F02P 3/02; F02P 3/055

See application file for complete search history.

(56) References Cited

U.S. PATENT DOCUMENTS

| | | | | | |
|---|---|---|---|---|---|
| 5,485,825 | A * | 1/1996 | Shimizu | F02P 3/0552 | 123/634 |
| 5,558,074 | A * | 9/1996 | Fukatsu | F02P 3/02 | 123/647 |
| 5,622,157 | A * | 4/1997 | Murata | F02P 3/02 | 123/647 |
| 5,642,253 | A * | 6/1997 | Shreve | F02P 3/0435 | 361/152 |
| 5,662,091 | A * | 9/1997 | Sawazaki | F02P 3/02 | 123/647 |
| 5,708,566 | A * | 1/1998 | Hunninghaus | H05K 1/0206 | 174/252 |
| 5,870,012 | A * | 2/1999 | Sakamaki | H01T 13/44 | 336/107 |
| 5,895,973 | A * | 4/1999 | Fessenden | H01L 24/28 | 257/713 |
| 9,797,292 | B2 | 10/2017 | Andersen | | |
| 10,056,185 | B2 * | 8/2018 | Yamane | H01F 27/325 | |
| 2002/0012230 | A1 * | 1/2002 | Oishi | F02P 3/0552 | 361/704 |

(Continued)

FOREIGN PATENT DOCUMENTS

| | | | |
|---|---|---|---|
| CN | 204117819 U | | 1/2015 |
| JP | 2011-H05209 | * | 6/2011 |
| KR | 19980044557 U | | 9/1998 |

*Primary Examiner* — Phutthiwat Wongwian
*Assistant Examiner* — Sherman D Manley
(74) *Attorney, Agent, or Firm* — Brooks Kushman P.C.

(57) ABSTRACT

An ignition system for a vehicle includes an ignition coil and a thermoelectric cooler. The ignition coil has primary and secondary coils. The ignition coil is configured to deliver electrical power from a battery to a least one spark plug. The thermoelectric cooler is disposed along an external surface of the ignition coil and is configured to transfer heat generated by the primary and secondary coils to an ambient surrounding.

20 Claims, 4 Drawing Sheets

(56) References Cited

U.S. PATENT DOCUMENTS

| | | | | |
|---|---|---|---|---|
| 2003/0087448 | A1* | 5/2003 | Abe | G01F 15/006 436/73 |
| 2003/0222743 | A1* | 12/2003 | Kondo | F02P 3/02 336/90 |
| 2004/0011342 | A1* | 1/2004 | Fukatsu | F02P 11/06 123/630 |
| 2004/0041675 | A1* | 3/2004 | Gernert | F02P 3/02 336/90 |
| 2012/0053818 | A1* | 3/2012 | Sackman | F02D 35/02 701/102 |
| 2015/0211575 | A1* | 7/2015 | Kim | H01F 27/08 310/90.5 |

* cited by examiner

IGNITION COIL AND IGNITION SYSTEM FOR A VEHICLE

TECHNICAL FIELD

The present disclosure relates to ignition coils and ignition systems for vehicles.

BACKGROUND

The ignition system of an internal combustion engine includes an ignition coil that is configured to increase the voltage of electricity that is being delivered from a battery to the spark plugs of the internal combustion engine in order to create the spark to ignite the fuel powering the internal combustion engine.

SUMMARY

An ignition coil includes a housing, a primary coil, a secondary coil, a thermoelectric cooler, and electrical contacts. The housing defines an internal cavity and an electrical receptacle. The primary and secondary coils are disposed within the cavity. The thermoelectric cooler is disposed along an external surface of the housing and is configured to transfer heat generated by the primary and secondary coils to an ambient surrounding. The electrical contacts protrude from the housing within the receptacle. The electrical contacts are configured to connect the primary coil and the thermoelectric cooler to an external power source.

An ignition coil for an internal combustion engine includes a housing, a primary coil, a secondary coil, and a thermoelectric cooler. The housing defines an internal cavity. The primary and secondary coils are disposed within the cavity. The thermoelectric cooler is disposed along an external surface of the housing and is configured to transfer heat generated by the primary and secondary coils to an ambient surrounding.

An ignition system for a vehicle includes an ignition coil and a thermoelectric cooler. The ignition coil has primary and secondary coils. The ignition coil is configured to deliver electrical power from a battery to a least one spark plug. The thermoelectric cooler is disposed along an external surface of the ignition coil and is configured to transfer heat generated by the primary and secondary coils to an ambient surrounding.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Ignition coils utilize an electrical transformer to convert low voltage energy from a vehicle electrical power system to high voltage energy in order to create a spark and combust a fuel/air mixture used to power an engine. Energy used by the ignition coil may be lost as heat within the transformer assembly. Furthermore, as the ignition coil heats up due to operation, the internal resistances will increase, leading to even more power dissipated as heat. When combined with the high heat operational environment of a vehicle engine compartment, proper thermal management of the ignition coil becomes increasingly important.

The ignition coil includes an integrated thermoelectric cooler that actively removes heat from the ignition coil and transfers the heat to the ambient air. The integrated thermoelectric cooler is capable of significantly reducing the internal temperature of the ignition coil in a high temperature environment, such as a vehicle engine compartment. This allows the ignition coil to either be operated longer, delivering more energy to the spark, or to be operated in hotter ambient conditions without damage.

Figure 1:
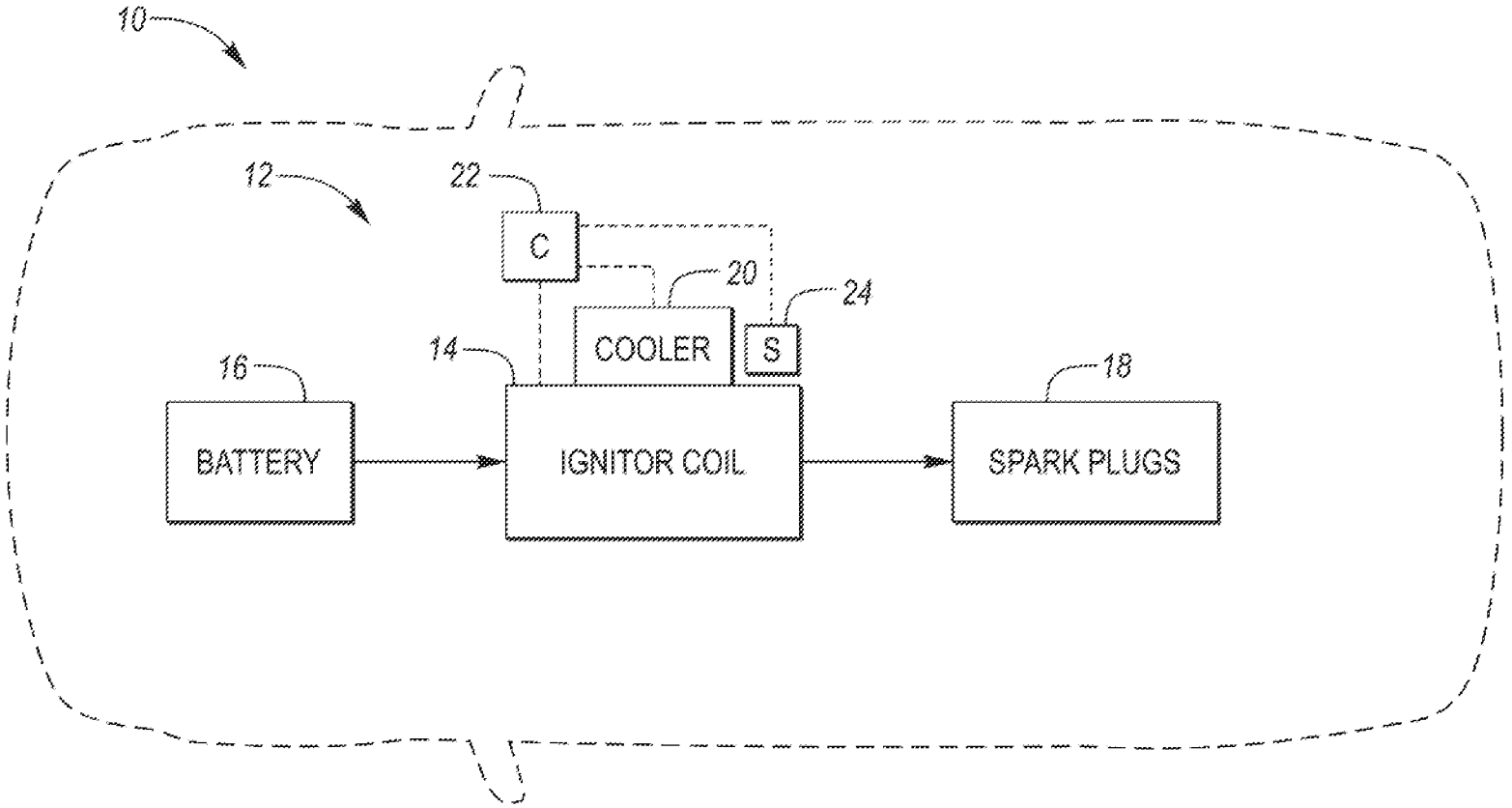
FIG. 1 is a schematic illustration of an exemplary vehicle and the ignition system of the vehicle.

Referring to FIG. 1, an exemplary vehicle 10 and the ignition system 12 of the vehicle 10 are illustrated. The ignition system 12 includes an ignition coil 14 that is configured to deliver electrical power from a battery 16 to at least one spark plug 18 of an internal combustion engine that generates power to propel the vehicle 10. An intermediate device (not shown), such as a distributor or an ignition controller, may be configured to direct the power to multiple spark plugs at various times based on the timing of the internal combustion engine. Alternatively, each spark plug 18 may receive electrical power from a separate ignition coil 14. A thermoelectric cooler 20 may be configured to transfer heat generated by the ignition coil 14 to the ambient surroundings. A controller 22 may be programmed to operate the ignition coil 14. More specifically, the controller may be programmed to switch the ignition coil 14 on and off based on the spark timing of the internal combustion engine.

Thermoelectric coolers use the Peltier effect to create a heat flux between the junction of two different types of materials. A Peltier cooler, heater, or thermoelectric heat pump is a solid-state active heat pump which transfers heat from one side of the device to the other, with consumption of electrical energy, depending on the direction of the current. Such an instrument is also called a Peltier device, Peltier heat pump, solid state refrigerator, or thermoelectric cooler (TEC). Thermoelectric coolers operate by the Peltier effect (which also goes by the more general name thermoelectric effect). A thermoelectric cooler has two sides, and when an electric current flows through the device, it brings heat from one side to the other, so that one side gets cooler while the other gets hotter. The hot side may be attached to a heat sink so that it remains at the temperature of the ambient surrounding, while the cool side may drop below the temperature of the ambient surrounding. In some applications, multiple coolers can be cascaded together for lower temperature.

The controller 22 may also be programmed to operate the thermoelectric cooler 20. More, specifically, the controller 22 may also be programmed to activate the thermoelectric cooler 20 in response to a temperature of the ignition coil 14 (which may be an measured internal temperature of the ignition coil 14 or an estimated internal temperature of the ignition coil 14) exceeding a threshold and to deactivate the thermoelectric cooler 20 in response to the temperature of the ignition coil decreasing to less than the threshold. A temperature sensor 24 may be configured to communicate the temperature of the ignition coil 14 to the controller 22. The temperature sensor may be disposed internally within the ignition coil 14 in order to obtain an accurate measurement of the internal temperature of the ignition coil 14.

Alternatively, if the ignition coil 14 is disposed within the engine compartment of the vehicle, the temperature of the ambient air within the engine compartment along with the current coil dwell condition (i.e., the length of time electric current is flowing through the primary coil of the ignition coil 14), which is indicative of the heat being produced by the ignition coil 14, may be used to estimate the temperature of the ignition coil 14. An algorithm that estimates the coil temperature based on the ambient air within the engine compartment and the current coil dwell condition may be stored within the controller 22. A sensor may be used to measure the temperature of the engine compartment and to communicate the temperature of the engine compartment to the controller 22. If not directly measured, the temperature of the ambient air within the engine compartment near the ignition coil 14 may be estimated by based the temperature of the engine coolant. A sensor may communicate the engine coolant temperature to the controller 22. An algorithm that estimates the engine compartment temperature based on the measured engine coolant temperature may be stored within the controller 22.

While illustrated as one controller, the controller 22 may be part of a larger control system and may be controlled by various other controllers throughout the vehicle 10, such as a vehicle system controller (VSC). It should therefore be understood that the controller 22 and one or more other controllers can collectively be referred to as a "controller" that controls various actuators in response to signals from various sensors to control various functions of the vehicle 10. The controller 22 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or nonvolatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 22 in controlling the vehicle 10.

Figure 2A:
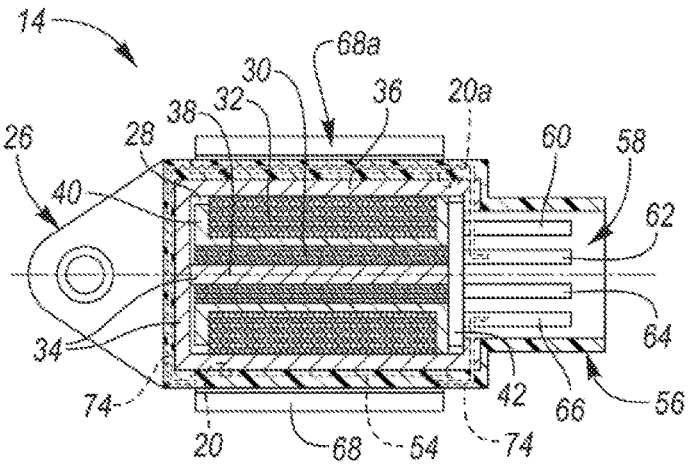
FIGS. 2A-2C illustrate a first embodiment of an ignition coil that is a subcomponent of the ignition system.
Figure 2B:
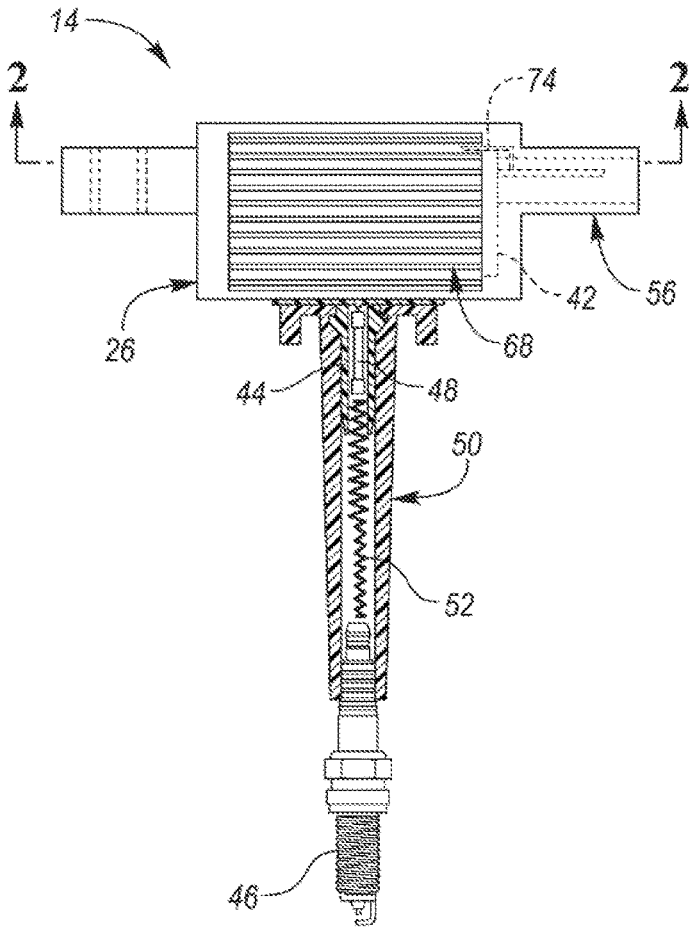
Figure 2C:
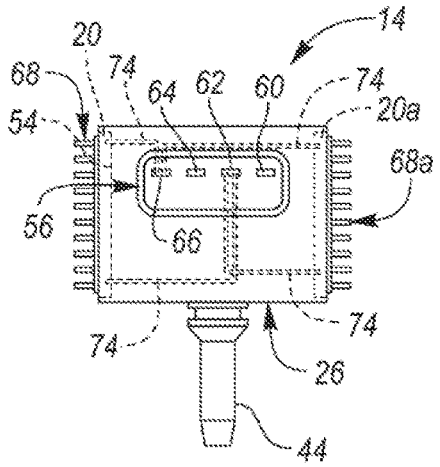

Referring to FIGS. 2A, 2B, and 2C, top, front, and side views of the ignition coil 14 are illustrated, respectively. The ignition coil 14 includes an external case or housing 26 that defines an internal cavity 28. A top surface of the housing 26 has been removed in FIG. 2A so that the internal components of the ignition coil 14 that are disposed within the cavity 28 are viewable. Furthermore, the internal components that are disposed within the internal cavity 28 are shown as a cross-section in FIG. 2A taken along line 2-2 in FIG. 2B. A primary coil 30, a secondary coil 32, and a magnetic iron core 34 are disposed within the internal cavity 28. The magnetic iron core 34 may be comprised of a core side 36 and a core center 38. The core side 36 and the core center 38 may be separate components or maybe integral to each other. A spool 40 may separate the primary coil 30 from the secondary coil 32. The spool 40 may be made from a material that provides electrical insulation.

An igniter module 42 that includes a switching circuit to turn the ignition coil 14 on and off may also be disposed within the internal cavity 28. The primary coil 30, secondary coil 32, magnetic iron core 34, spool 40, and igniter module 42 may all be collectively encased with in an insulating material, such as an epoxy, that fills any remaining voids within the cavity 28 that is not occupied by the primary coil 30, secondary coil 32, magnetic iron core 34, spool 40, or igniter module 42. The ignition coil 14 includes a terminal 44 that is configured to establish an electrical connection between the secondary coil 32 and a spark plug 46. A resistor 48 that is configured to reduce noise of the ignition system 12 may be disposed within the terminal 44. A plug wire 50 is configured to establish an electrical connection between the terminal 44 and the spark plug 46. More specifically the plug wire 50 may include an internal conducting element 52, such as a spring, that establishes the electric connection between the terminal 44 and the spark plug 46. The resistor 48 may engage an electrical contact within the terminal 44 and the internal conducting element 52 when under spring force to establish an electrical connection between the secondary coil 32 and the spark plug 46. The plug wire 50 and the terminal 44 are shown as cross-sections in FIG. 2B, so that the internal connections of the plug wire 50 and terminal 44 (i.e., the internal conducting element 52 and the resistor 48) that establish the electrical connection between the secondary coil 32 and a spark plug 46 may be observed.

A first thermoelectric cooler 20 is disposed along an external surface 54 of the housing 26. The first thermoelectric cooler 20 is configured to transfer heat generated by the primary coil 30 and secondary coil 32 to an ambient surrounding, which may be the engine compartment of the vehicle 10. The external surface 54 may be a recessed surface that extends inward into the housing 26. The housing 26 may define an electrical receptacle 56. A series of electrical contacts 58 may protrude from the housing 26 within the receptacle 56. A top surface of the receptacle 56 has been removed in FIG. 2A so that the series of electrical contacts 58 may be observed. A first of the electrical contacts 60 is configured to connect the igniter module 42 and primary coil 30 to a positive terminal of a power source, such as battery 16. A second of the electrical contacts 62 is configured to connect the first thermoelectric cooler 20 and any additional thermoelectric coolers that are secured to the ignition coil 14 to the positive terminal of the power source. A third of the electrical contacts 64 is configured to connect the igniter module 42 to a controller, such as controller 22, which is configured to operate the switching unit within the igniter module 42 to switch the ignition coil 14 between the on and off states. A fourth of the electrical contacts 66 is configured to connect the igniter module 42, primary coil 30, first thermoelectric cooler 20, and any addition thermoelectric coolers to a negative terminal of a power source and/or to ground.

A heat sink 68 may be secured to an opposing side of the thermoelectric cooler 20 relative to the external surface 54 of the housing 26. The heat sink 68 may be configured to transfer heat from the thermoelectric cooler 20 to the ambient surrounding (e.g., the air surrounding the ignition coil, Which may be the air within an engine compartment). The heat sink 68 may be comprised of a material that has high capability of transferring heat between two mediums, such as metallic material. More specifically, the heat sink 68 may be comprised of iron, steel, aluminum, an aluminum alloy, magnesium, a magnesium alloy, or any other material that is known to have a high capability of transferring heat between two mediums. The heat sink 68 may consist of a base plate 70 that disposed on an external surface of the thermoelectric cooler 20 and a plurality of fins 72 that protrude outward from the base plate 70. The plurality of fins 72 also protrude outward and away from the ignition coil 14 and the thermoelectric cooler 20.

A second thermoelectric cooler 20*a* may be disposed along a second external surface of the housing 26. The second external surface may be an opposing and opposite surface relative to the first external surface 54. The second thermoelectric cooler 20*a* is configured to transfer heat generated by the primary coil 30 and secondary coil 32 to an ambient surrounding, which may be the engine compartment of the vehicle 10. The second external surface may be a recessed surface that extends inward into the housing 26. The second of the electrical contacts 62 may also be configured to connect the second thermoelectric cooler 20*a* to the positive terminal of the power source. The fourth of the electrical contacts 66 may also be configured to connect the second thermoelectric cooler 20*a* to the negative terminal of a power source and/or to ground. Alternatively, the series of electrical contacts 58 may include fifth and/or sixth electrical contacts that protrude from the housing 26 within the receptacle 56 that are configured to connect the second thermoelectric cooler 20*a* to the positive terminal of the power source and the negative terminal of a power source and/or to ground, respectively.

A second heat sink 68*a* may be secured to an opposing side of the second thermoelectric cooler 20*a* relative to the second external surface of the housing 26. The second heat sink 68*a* may be configured to transfer heat from the second thermoelectric cooler 20*a* to the ambient surrounding. The second heat sink 68*a* may be comprised of a material that has high capability of transferring heat between two mediums, such as metallic material. More specifically, the second heat sink 68*a* may be comprised of iron, steel, aluminum, an aluminum alloy, magnesium, a magnesium alloy, or any other material that is known to have a high capability of transferring heat between two mediums. The second heat sink 68*a* may consist of a base plate that disposed on an external surface of the second thermoelectric cooler 20*a* and a plurality of fins that protrude outward from the base plate. The plurality of tins may also protrude outward and away from the ignition coil 14 and the second thermoelectric cooler 20*a*.

The first thermoelectric cooler 20 and the second thermoelectric cooler 20*a* may be electrically connected to the second of the electrical contacts 62 and the fourth of the electrical contacts 66 via wires 74 that are routed through the ignition coil 14. Alternatively, the second thermoelectric cooler 20*a* may be electrically connected fifth and sixth electrical contacts (not shown) via wires 74 that are routed through the ignition coil 14. More specifically, the wires 74 may be routed through the housing 26 or the insulating material that fills any remaining voids within the cavity 28. Orifices or channels may be defined by the housing 26 or the insulating material for routing the wires 74.

Figure 3A:
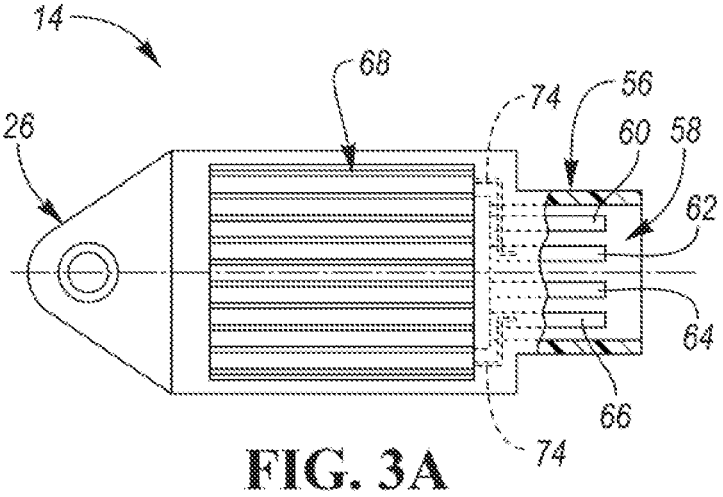
FIGS. 3A-3C illustrate a second embodiment of the ignition coil.
Figure 3B:
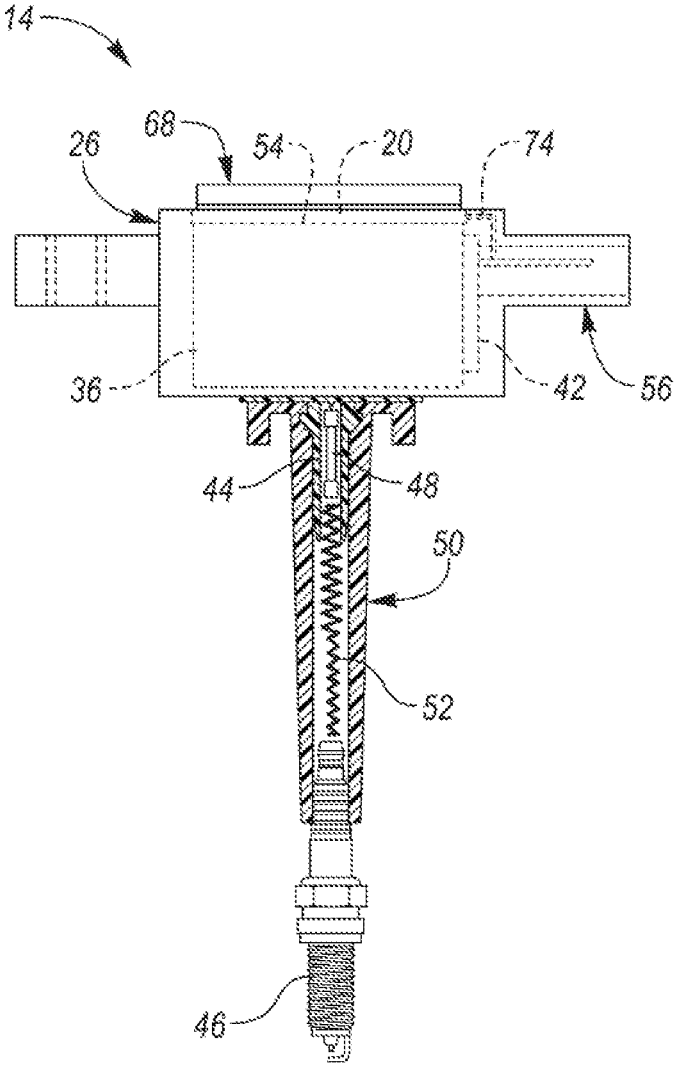
Figure 3C:
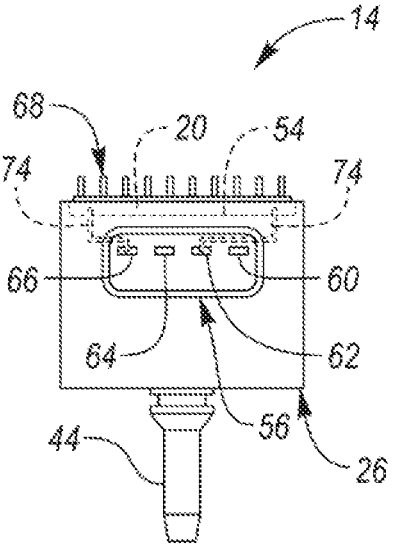
Figure 4A:
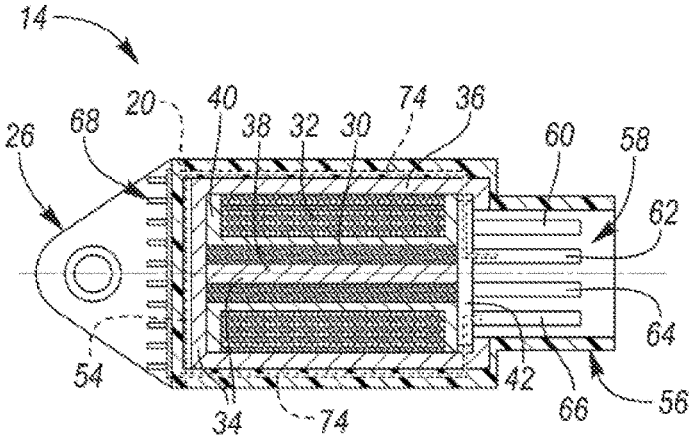
FIGS. 4A-4C illustrate a third embodiment of the ignition coil.
Figure 4B:
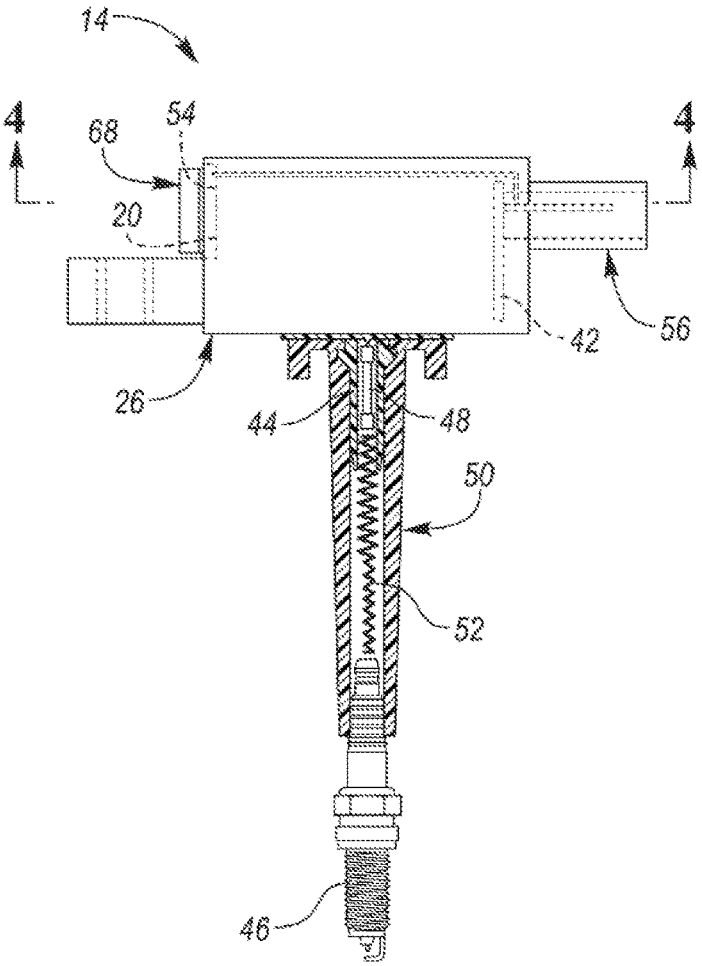
Figure 4C:
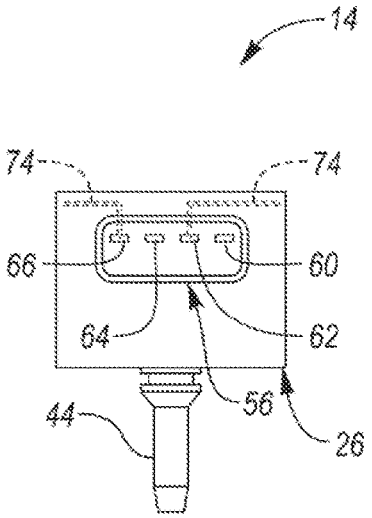

The first embodiment of the ignition coil 14 depicts a pair of thermoelectric coolers 20, 20*a* that are disposed on opposing surfaces of the ignition coil 14, or more specifically opposing surfaces of the housing 26. However, it should be understood that the thermoelectric coolers may be disposed on any of the external surfaces of the ignition coil 14, or more specifically any surface of the housing 26, including a top surface, a bottom surface, a front surface, a rear surface, or a side surface. Furthermore, the ignition coil 14 may include any number (i.e., one or more) thermoelectric coolers and/or an associated heat sink that are disposed on any of the external services of the ignition coil, or more specifically any of the external surfaces of the housing 26. For example, FIGS. 3A-3C depict a second embodiment of the ignition coil 14 that includes only one thermoelectric cooler 20 that is secured to a top surface of the ignition coil 14, or more specifically to a top surface of the housing 26. It should also be noted, that the top surface is illustrated as recessed in FIGS. 3A-3C. As another example, FIGS. 4A-4C depict a third embodiment of the ignition coil 14 that includes only one thermoelectric cooler 20 that is secured to a rear surface of the ignition coil 14, or more specifically to a rear surface of the housing 26. It should also be noted, that the rear surface is illustrated as recessed in FIGS. 4A-4C. A top surface of the housing 26 has been removed in FIG. 4A so that the internal components of the ignition coil 14 that are disposed within the cavity 28 are viewable. Furthermore, the internal components that are disposed within the internal cavity 28 are shown as a cross-section in FIG. 4A taken along line 44 in FIG. 2B.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. An ignition coil comprising:

a housing defining an internal cavity and an electrical receptacle;

primary and secondary coils disposed within the cavity;

a thermoelectric cooler disposed on an external surface of the housing and configured to transfer heat generated by the primary and secondary coils to an ambient surrounding; and electrical contacts protruding from the housing within the receptacle and configured to connect the primary coil and the thermoelectric cooler to an external power source.

2. The ignition coil of claim 1, wherein the external surface is a recessed surface.

3. The ignition coil of claim 1 further comprising a heat sink configured to transfer heat from the thermoelectric cooler to the ambient surrounding, wherein the heat sink is secured to an opposing side of the thermoelectric cooler relative to the external surface.

4. The ignition coil of claim 3, wherein the heat sink includes a plurality of fins that protrude outward from the ignition coil.

5. The ignition coil of claim 1 further comprising a second thermoelectric cooler disposed along a second external surface of the housing and configured to transfer heat generated by the primary and secondary coils to the ambient surrounding.

6. The ignition coil of claim 1, wherein the thermoelectric cooler is electrically connected to the electrical contacts via wires that are routed through the ignition coil.

7. An ignition coil for an internal combustion engine comprising:

a housing defining an internal cavity;

primary and secondary coils disposed within the cavity; and a thermoelectric cooler disposed on an external surface of the housing and configured to transfer heat generated by the primary and secondary coils to an ambient surrounding.

8. The ignition coil of claim 7, wherein the housing defines an electrical receptacle, the ignition coil further comprises electrical contacts that protrude from the housing within the receptacle, wherein the electrical contacts are configured to connect the primary coil and the thermoelectric cooler to an external power source.

9. The ignition coil of claim 7, wherein the external surface is a recessed surface.

10. The ignition coil of claim 7 further comprising a heat sink configured to transfer heat from the thermoelectric cooler to the ambient surrounding, wherein the heat sink is secured to an opposing side of the thermoelectric cooler relative to the external surface.

11. The ignition coil of claim 10, wherein the heat sink includes a plurality of fins that protrude outward from the ignition coil.

12. The ignition coil of claim 7 further comprising a second thermoelectric cooler disposed along a second external surface of the housing and configured to transfer heat generated by the primary and secondary coils to the ambient surrounding.

13. The ignition coil of claim 7, wherein the thermoelectric cooler is electrically connected to electrical contacts via wires that are routed through the ignition coil.

14. An ignition system for a vehicle comprising:

an ignition coil having primary and secondary coils, the ignition coil configured to deliver electrical power from a battery to a least one spark plug; and a thermoelectric cooler disposed on an external surface of the ignition coil and configured to transfer heat generated by the primary and secondary coils to an ambient surrounding.

15. The ignition system of claim 14, wherein ignition coil defines an electrical receptacle and further comprises electrical contacts that protrude from the ignition coil within the receptacle, wherein the electrical contacts are configured to connect the primary coil and the thermoelectric cooler to an external power source.

16. The ignition system of claim 14 further comprising a heat sink having a plurality of fins that protrude outward from the ignition coil, wherein the heat sink is configured to transfer heat from the thermoelectric cooler to the ambient surrounding, and wherein the heat sink is secured to an opposing side of the thermoelectric cooler relative to the external surface.

17. The ignition system of claim 14 further comprising a second thermoelectric cooler disposed along a second external surface of the ignition coil and configured to transfer heat generated by the primary and secondary coils to the ambient surrounding.

18. The ignition system of claim 14, wherein the thermoelectric cooler is electrically connected to electrical contacts via wires that are routed through the ignition coil.

19. The ignition system of claim 14 further comprising a controller that is programmed to, in response to a temperature of the ignition coil exceeding a threshold, activate the thermoelectric cooler.

20. The ignition system of claim 19 further comprising a controller that is programmed to, in response to the temperature of the ignition coil decreasing to less than the threshold, deactivate the thermoelectric cooler.

* * * * *